US009039124B2

(12) United States Patent
Ogimura et al.

(10) Patent No.: US 9,039,124 B2
(45) Date of Patent: May 26, 2015

(54) PRINTER

(71) Applicant: SEIKO EPSON CORPORATION, Tokyo (JP)

(72) Inventors: Takafumi Ogimura, Nagano (JP); Atsushi Sumii, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/448,238

(22) Filed: Jul. 31, 2014

(65) Prior Publication Data

US 2015/0062228 A1 Mar. 5, 2015

(30) Foreign Application Priority Data

Aug. 30, 2013 (JP) ..... 2013-179104

(51) Int. Cl.

| | |
|---|---|
| ***B41J 29/38*** | (2006.01) |
| ***B41J 13/00*** | (2006.01) |
| ***B41J 13/02*** | (2006.01) |
| *B41J 2/01* | (2006.01) |

(52) U.S. Cl.

CPC ..... *B41J 13/0009* (2013.01); *B41J 13/02* (2013.01)

(58) Field of Classification Search

CPC ..... B41J 11/00; B41J 11/05; B41J 11/006; B41J 11/007; B41J 11/008; B41J 3/60; B41J 13/00; B41J 13/042; B41J 13/048

USPC ..... 347/16, 101, 104

See application file for complete search history.

(56) References Cited

U.S. PATENT DOCUMENTS

| | | | | | |
|---|---|---|---|---|---|
| 5,604,597 | A | * | 2/1997 | Imai | 358/296 |
| 5,673,074 | A | * | 9/1997 | Miyauchi et al. | 347/104 |
| 5,870,114 | A | * | 2/1999 | Numata et al. | 347/16 |
| 5,910,811 | A | * | 6/1999 | Sato | 347/104 |
| 6,231,159 | B1 | * | 5/2001 | Taniguro | 347/37 |
| 8,157,368 | B2 | * | 4/2012 | Yoshida et al. | 347/104 |
| 2011/0187780 | A1 | * | 8/2011 | Oki et al. | 347/14 |
| 2011/0187781 | A1 | * | 8/2011 | Oki et al. | 347/14 |
| 2012/0050361 | A1 | * | 3/2012 | Shinohara et al. | 347/9 |

FOREIGN PATENT DOCUMENTS

| | | | | | |
|---|---|---|---|---|---|
| JP | 08169125 | A | * | 7/1996 | B41J 2/18 |
| JP | 09150560 | A | * | 6/1997 | B41J 19/18 |
| JP | 2002036671 | A | * | 2/2002 | B41J 29/38 |
| JP | 2006-159771 | A | | 6/2006 | |
| JP | 2011161719 | A | * | 8/2011 | |

* cited by examiner

*Primary Examiner* — Jannelle M Lebron
*Assistant Examiner* — Jeremy Bishop
(74) *Attorney, Agent, or Firm* — Global IP Counselors, LLP

(57) ABSTRACT

A printer includes a pair of input rollers, a pair of output rollers, a print head and a control section. The control section is configured to transport a print medium by rotating the input rollers and the output rollers after printing on a target region and before printing on a next target region. The control section is configured to determine, before carrying out transporting, whether a combination of the input rollers and the output rollers which pinch the print medium would change in a case where the print medium were transported from a current position to a next target position, and, in a case where there would be a change, the control section being configured to transport the print medium from the current position to the target position in a retracted state where the print head is moved to an outside of a range where the print medium passes.

9 Claims, 7 Drawing Sheets

PRINTER

CROSS-REFERENCE TO RELATED APPLICATIONS

This application claims priority to Japanese Patent Application No. 2013-179104 filed on Aug. 30, 2013. The entire disclosure of Japanese Patent Application No. 2013-179104 is hereby incorporated herein by reference.

BACKGROUND

1. Technical Field

The present invention relates to a printer.

2. Related Art

Serial printers carry out printing while moving a print head in a direction which is orthogonal to the transport direction of a sheet. When sheets are transported in a state where the sheets comes into contact with the print head, the sheets may be jammed in a transport path or the print quality may be decreased by ink being attached to the sheet. Techniques are known where the print head is moved to the outside of a range where the sheets pass in order to prevent the print head and the sheet which is being transported from coming into contact. In the printer which is described in Japanese Unexamined Patent Application Publication No. 2006-159771, the print head is moved to the outside of the range where the sheets pass prior to transporting of the sheets in a case where the current position of the print head with regard to the sheet in the sheet transport direction is a predetermined region where stopping is not permitted.

SUMMARY

However, there are times when the sheets come into contact with the print head during transporting of the sheets in the printer which is described in the above mentioned publication since the print head is not moved to the outside of the range where the sheets pass in advance according to the position of the print head after transporting of the sheets. For example, it is assumed that the print head is not moved to the outside of the range where the sheets pass as in the printer which is described in the above mentioned publication in a case where, after printing is performed in a state where the sheet is pinched between both of the input rollers which are provided on the upstream side of the print head and output rollers which are provided on the downstream side of the print head, the sheets are transported from input rollers to a position where the rear edge of the sheet is released. In this case, when the sheet is released from the input rollers during transporting of the sheet, there are times when the rear edge of the sheet comes into contact with the print head due to warping.

The present invention is created in order to solve such a problem and has an object of preventing a print medium from coming into contact with a print head.

(1) A printer for achieving the object described above which is provided with a pair of input rollers which pinch a print medium, a pair of output rollers which pinch the print medium, a print head which prints onto a target region on the print medium while moving between the input rollers and the output rollers in a direction which intersects with the transport direction of the print medium, and a control section which transports the print medium by rotating the input rollers and the output rollers in a retracted state where the print head is retracted to the outside of the range where the print medium passes or in a non-retracted state where the print head is not retracted to the outside of the range where the print medium passes after printing on a first target region and before printing on a second target region, where the control section determines, before the print medium is transported from the current position, whether or not the combination of the input rollers and the output rollers which pinch the print medium would change if the print medium were transported from the current position to a target position, and, in a case where there would be a change, transports the print medium from the current position to the target position in the retracted state after the print head is moved to the outside of the range where the print medium passes.

According to the present invention, in a case where the combination of the input rollers and the output rollers which pinch the print medium changes when the print medium is transported to the target position, it is possible to prevent the print medium from coming into contact with the print head during transporting of the print medium since it is possible to move the print head to the outside of the range where the print medium passes in advance prior to transporting of the print medium.

(2) The printer for achieving the object described above, where the control section may transport the print medium from the current position to the target position in the retracted state after the print head is moved to the outside of the range where the print medium passes in a case where a state where the print medium is pinched by either pair of the input rollers or the output rollers is changed to a state where the printing medium is pinched by both pairs of the input rollers and the output rollers when the print medium is transported from the current position to the target position.

When this configuration is adopted, it is possible to prevent the print medium from coming into contact with the print head due to the print medium hitting the input rollers or the output rollers and bending.

(3) The printer for achieving the object described above, where the control section may transport the print medium from the current position to the target position in the retracted state after the print head is moved to the outside of the range where the print medium passes in a case where a state where the print medium is pinched by both pairs of the input rollers and the output rollers is changed to a state where the printing medium is pinched by either pairs of the input rollers or the output rollers when the print medium is transported from the current position to the target position.

When this configuration is adopted, it is possible to prevent the print medium from coming into contact with the print head due to the print medium which is released from the input rollers or the output rollers being warped upward.

(4) The printer for achieving the object described above, where the control section may transport the print medium also during movement of the print head in a case where the print medium is pinched by both pairs of the input rollers and the output rollers and need not transport the print medium during movement of the print head in a case where the print medium is pinched by either pair of the input rollers or the output rollers.

When this configuration is adopted, since the transport time band of the print medium and the moving time band of the print head overlap, it is possible to shorten the time for printing and it is possible to prevent the print medium from coming into contact with the print head.

(5) A printer for achieving the object described above which is provided with a pair of input rollers which pinch a print medium, a pair of output rollers which pinch the print medium, a print head which prints onto a target region on the print medium while moving between the input rollers and the output rollers in a direction which intersects with the transport direction of the print medium, and a control section which transports the print medium by rotating the input rollers and the output rollers in a retracted state where the print head is retracted to the outside of the range where the print medium passes or in a non-retracted state where the print head is not retracted to the outside of the range where the print medium passes after printing on a first target region and before printing on a second target region, where, in a case where the print medium is transported to the target position by being pinched by either one of the input rollers or the output rollers after printing on the final target region on one surface of the print medium, the control section transports the print medium from the current position to the target position in the retracted state after the print head is moved to the outside of the range where the print medium passes.

According to the present invention, it is possible to prevent the print medium from coming into contact with the print head due to the print medium, which is released from either pair of the input rollers or the output rollers after printing is complete, being warped upward.

(6) The printer for achieving the object described above, where the control section may move the print head to the outside of the range where the print medium passes before the print medium is transported from the current position in a direction from the input rollers toward the output rollers after printing on the final target region of the print medium.

When this configuration is adopted, it is possible to prevent the print medium from coming into contact with the print head when the print medium is discharged.

(7) The printer for achieving the object described above, where the control section may move the print head to the outside of the range where the print medium passes before the print medium is transported from the current position in a direction from the output rollers toward the input rollers in order to carry out printing on a second surface of the print medium after printing on a first surface of the print medium.

When this configuration is adopted, it is possible to prevent the print medium from coming into contact with the print head when transporting is carried out in the opposite direction in order to reverse the print medium after printing is complete on the first surface during double-sided printing.

(8) The printer for achieving the object described above, where the control section may set a movement target for the print head which corresponds to the target region which is outside of the range where the print medium passes before carrying out printing on the target region.

When this configuration is adopted, it is possible to shorten the time for printing until the print head moves outside of the range where the print medium passes after printing on the target region since the print head does not stop inside the range where the print medium passes.

(9) The printer for achieving the object described above, where the control section may set the retracted position of the print head based on the width of the print medium which is set in a print job.

When this configuration is adopted, it is possible to shorten the distance over which the print head is moved, after printing on the target region in order to move the print head to the outside of the range where the print medium passes, according to the width of the print medium. Accordingly, it is possible to shorten the time for printing.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
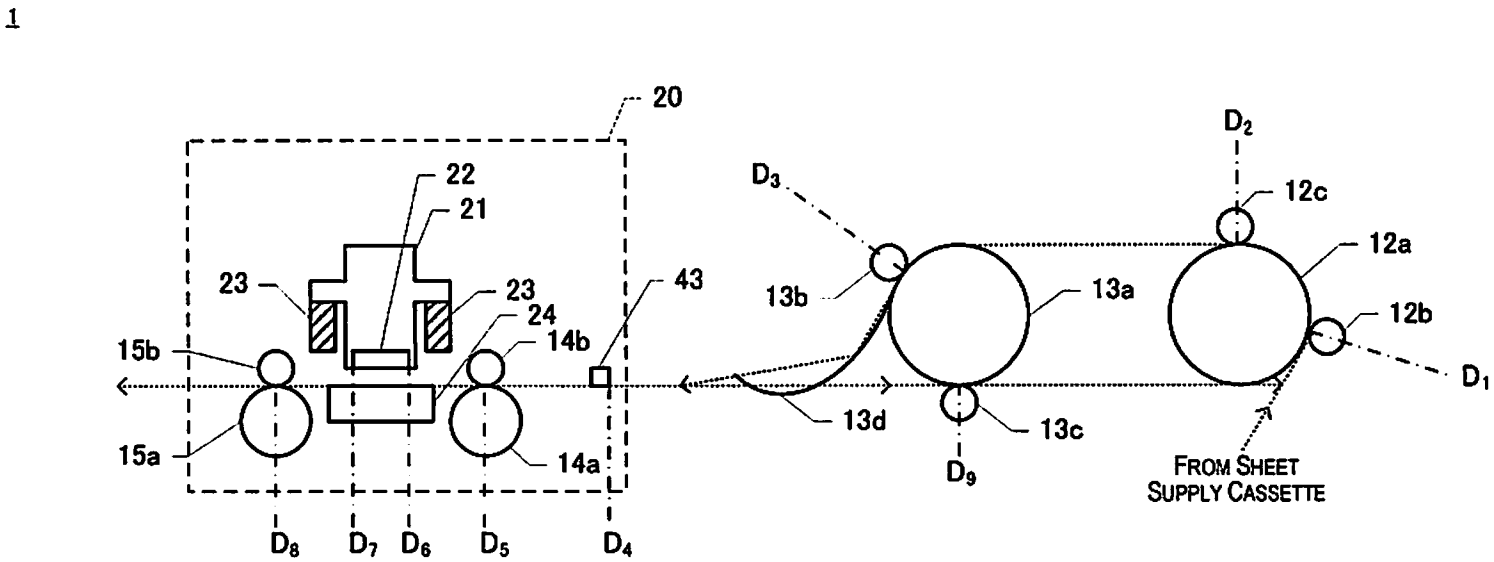
FIG. 1 is a schematic diagram of an embodiment of the present invention.

Below, an embodiment of the present invention will be described with reference to the attached drawings. Here, the same reference numerals are given to the constituent elements which correspond in each of the diagrams and overlapping descriptions are omitted.

1. Printer Configuration

Figure 2:
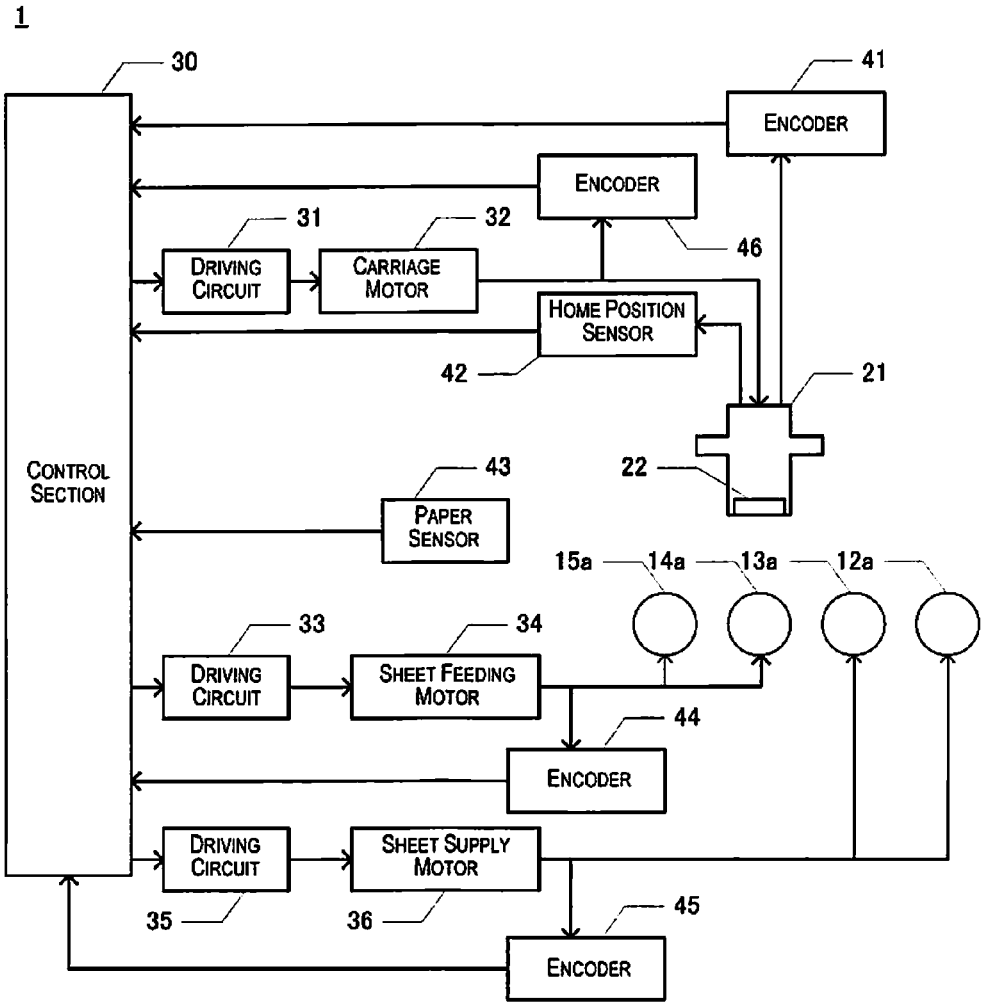
FIG. 2 is a block diagram of an embodiment of the present invention.

The configuration of a printer 1 which is an embodiment of the present invention is shown in FIG. 1 and FIG. 2. The printer 1 is a serial ink jet printer which executes a print job by sending out sheets P which are print media, which are stacked in a sheet supply cassette which is not shown in the diagram, one sheet at a time between a platen 24 and a print head 22. A reversing roller 12*a*, a relay roller 13*a*, an input roller 14*a*, and an output roller 15*a* are provided in a sheet transport path which is shown by a dotted line in FIG. 1.

The reversing roller 12*a* and the relay roller 13*a* are driven by a sheet supply motor 36. The relay roller 13*a* sends out sheets, which are drawn out from the sheet supply cassette which is not shown in the diagram, and sheets, which are sent back by the input roller 14*a*, toward the input rollers 14*a* by being rotated counterclockwise in FIG. 1. Driven rollers 12*b* and 12*c* which come into contact with the reversing roller 12*a* and rotate along with the reversing roller 12*a* are provided in the periphery of the reversing roller 12*a*. Driven rollers 13*b* and 13*c* which come into contact with the relay roller 13*a* and rotate along with the relay roller 13*a* are provided in the periphery of the relay roller 13*a*.

The input roller 14*a* rotates along with a driven roller 14*b* which is an input roller by being driven by a sheet feeding motor 34. The output roller 15*a* rotates along with a driven roller 15*b* which is an output roller by being driven by the sheet feeding motor 34. Here, a direction in which the sheet advances from the input roller 14*a* toward the output roller 15*a* is a forward direction and a direction in which the sheet advances from the output roller 15*a* toward the input roller 14*a* is a backward direction. As will be described later, the input roller 14*a* and the output roller 15*a* transport the sheet in the forward direction by rotating counterclockwise in FIG. 1 when printing is being carried out on the first surface and the second surface of the sheet. In addition, the input roller 14*a* and the output roller 15*a* transport the sheet in the backward direction by rotating clockwise in FIG. 1 when printing on the first surface of the sheet is complete in a double-sided printing mode. Then, when printing on the second surface of the sheet is complete in the double-sided printing mode, the sheet is transported in the forward direction by rotating counterclockwise in FIG. 1, and the sheet is discharged onto a stacker which is not shown in the diagram.

The sheet supply motor 36 rotates the reversing roller 12*a* and the relay roller 13*a* by being driven by a driving circuit 35. The sheet feeding motor 34 rotates the input roller 14*a* and the output roller 15*a* by being driven by a driving circuit 33.

The displacement of the sheet is measured by a rotary encoder 45 which measures the rotation angle of the sheet supply motor 36, a rotary encoder 44 which measures the rotation angle of the sheet feeding motor 34, and a sheet sensor 43. The sheet sensor 43 is provided between the input roller 14*a* and the relay roller 13*a* as shown in FIG. 1. The sheet sensor 43 is an optical sensor which detects changes in the amount of light incident on the sheet sensor 43 which accompanies passing of the sheets.

The printer 1 is provided with a guide which is not shown in the diagram for transporting the sheet P along the transport path which is shown by the dotted line in FIG. 1. Here, the waypoints $D_1$, $D_2$, $D_3$, $D_4$, $D_5$, $D_6$, $D_7$, $D_8$, and $D_9$ are set as follows in the transport path of the sheet.

$D_1$: contact point of the reversing roller 12*a* and the driven roller 12*b*

$D_2$: contact point of the reversing roller 12*a* and the driven roller 12*c*

$D_3$: contact point of the relay roller 13*a* and the driven roller 13*b*

$D_4$: detection position of the sheet sensor 43

$D_5$: contact point of the input roller 14*a* and the driven roller 14*b*

$D_6$: position of the discharge port on the farthest upstream side of the print head 22

$D_7$: position of the discharge port on the farthest downstream side of the print head 22

$D_8$: contact point of the output roller 15*a* and the driven roller 15*b*

$D_9$: contact point of the relay roller 13*a* and the driven roller 13*c*

Here, a contact point is a contact point in a state where the sheet P is not being transported and is a nip point where the sheet is transported by being pinched in a state where the sheet is being transported.

A flexible guide 13*d* is provided between the input roller 14*a* and the relay roller 13*a*. The upper surface of the flexible guide 13*d* guides the front edge of the sheet between the input roller 14*a* and the driven roller 14*b* when the relay roller 13*a* transports the sheet in the forward direction. In addition, the bottom surface of the flexible guide 13*d* guides the front edge of the sheet between the relay roller 13*a* and the driven roller 13*c* when the input roller 14*a* transports the sheet in the backward direction.

In the double-sided printing mode, a control section 30 controls the reversing roller 12*a*, the relay roller 13*a*, the input roller 14*a*, and the output roller 15*a* such that the rear edge of the sheet passes in the order of $D_4$, $D_9$, $D_1$, $D_2$, $D_3$, $D_4$, $D_5$, $D_6$, $D_7$, and $D_8$ during printing on the first surface after the front edge of the sheet passes in the order of $D_1$, $D_2$, $D_3$, $D_4$, $D_5$, $D_6$, $D_7$, and $D_8$.

A carriage 21 where the print head 22 is mounted and the platen 24 are provided between the input roller 14*a* and the output roller 15*a*. A discharge port which is not shown in the diagram and which discharges ink droplets is formed in the print head 22. Ink droplets which are discharged from the print head 22 are attached to the sheet which is supported by the platen 24. The carriage 21 is supported by a guide rail 23 so as to be able to move back and forth in a direction which is orthogonal with regard to the transport direction of the sheet. The carriage 21 moves along the guide rail 23 due to rotation of a carriage motor 32. The carriage motor 32 is driven by a driving circuit 31 which is controlled by the control section 30.

Figure 7:
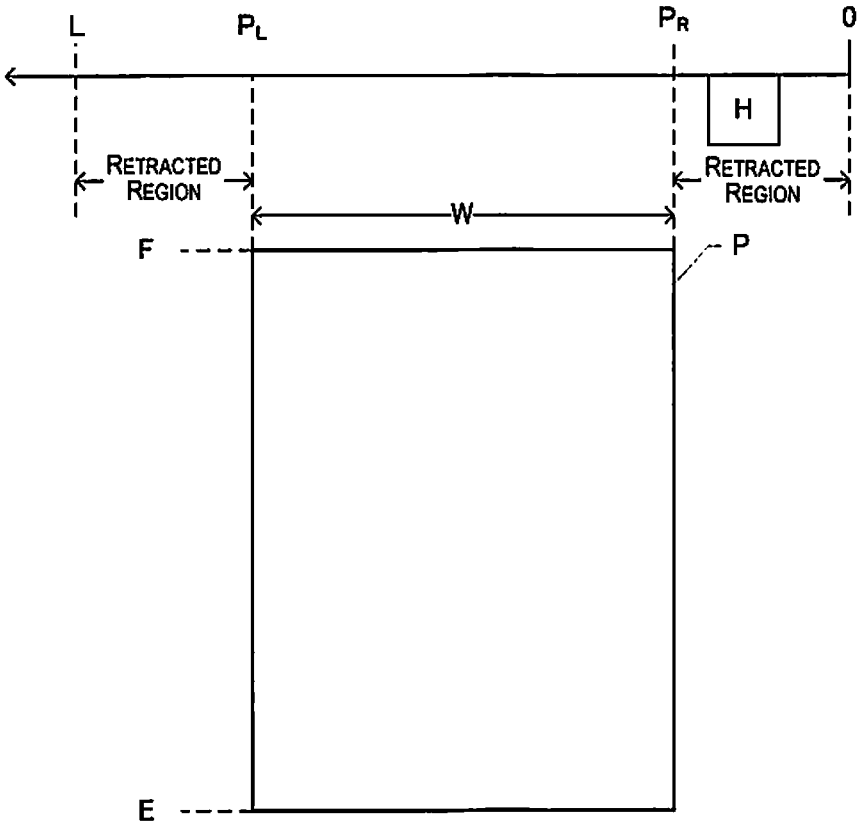
FIG. 7 is a planar diagram of an embodiment of the present invention.

A movement segment of the print head 22 is shown in FIG. 7. The width of the movement segment of the print head 22 is set to be wider than a maximum width W of the sheet on which it is possible for the printer 1 to print. A start point 0 and an end point L of the movement segment of the print head 22 are defined by a stopper which is hit by the carriage 21 and a wall of the housing of the printer 1. A sheet edge $P_R$ which is closest to the start point 0 of the range where the sheet P passes on the platen 24 is defined by walls of the sheet supply cassette such that the distance from the start point 0 to the sheet edge $P_R$ is longer than the length of the print head 22 in the moving direction. A home position H, where the print head 22 waits during a period when a print job is not being executed, is outside of the passing range of the sheet. A first retracted position is set in the movement segment of the print head 22 outside of the passing range of the sheet from the start point 0 to the sheet edge $P_R$.

The end point L of the movement segment of the print head 22 is defined such that a distance from a sheet edge $P_L$ which is furthest from the start point 0 of the range where the sheet P passes on the platen 24 to the end point L of the movement segment of the print head 22 is longer than the length of the print head 22 in the moving direction. In addition, a second retracted position is set in the movement segment of the print head 22 outside of the passing range of the sheet from the sheet edge $P_L$ which is furthest from the home position H to the end point L of the movement segment of the print head 22. Since the range where the sheets pass changes according to the size of the sheet which is set for the print job, the second retracted position is set according to the size of the sheet which is set for the print job.

The control section 30 is a computer which is provided with a processor, a memory, a ROM, an inputting and outputting circuit, and the like which are not shown in the diagram. The control section 30 controls the carriage motor 32, the sheet supply motor 36, the sheet feeding motor 34, and the print head 22 in accordance with a sequence which is determined in advance by the processor executing a control program by reading the control program from the ROM into the memory. Printing is carried out on the sheet by alternately repeating sub-scanning where the sheet is transported such that the target region on the sheet is positioned directly below the print head 22 and main scanning where ink is discharged from the print head 22 at a predetermined timing while the print head 22 is moving.

2. Overview of Double-Sided Printing

Figure 3:
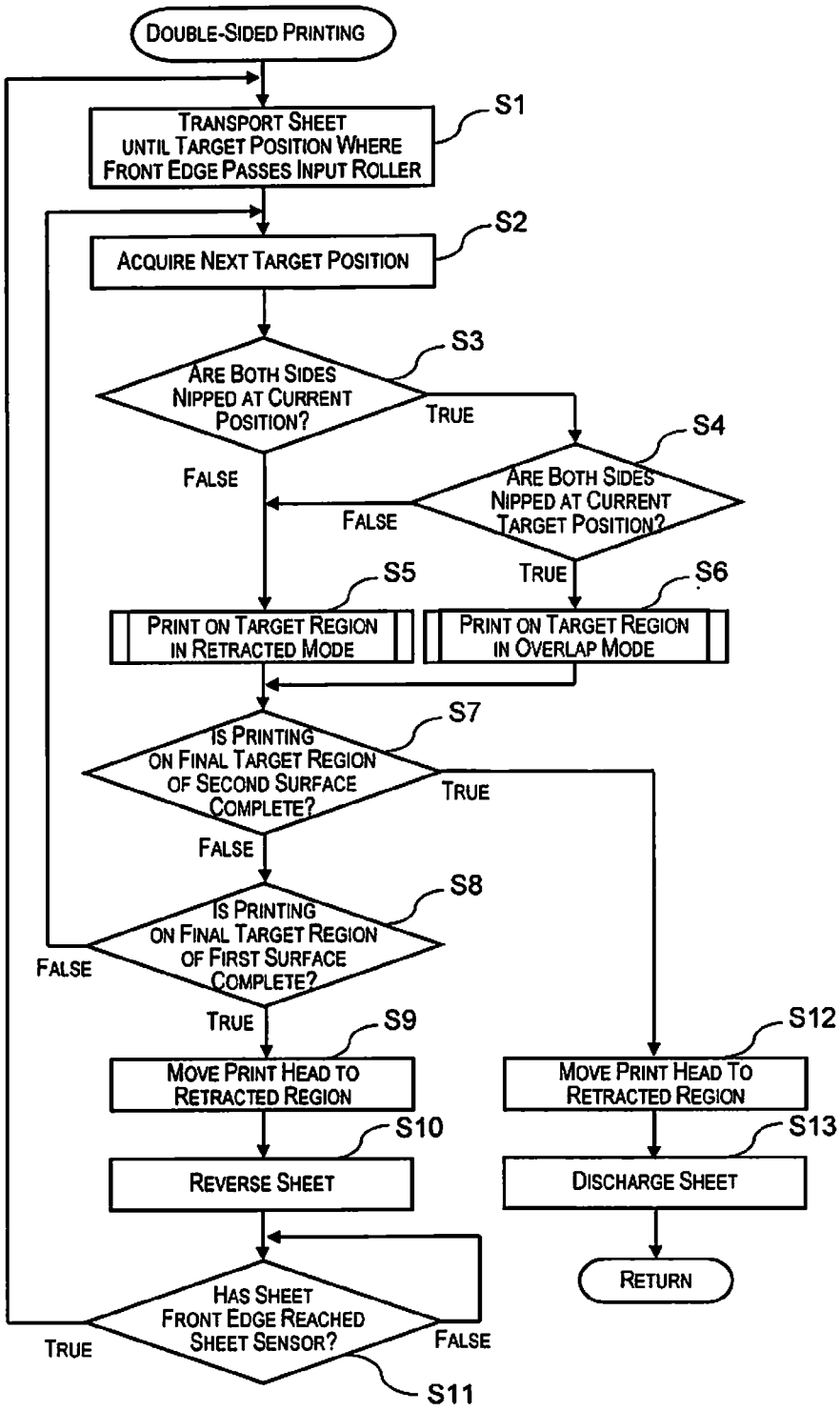
FIG. 3 is a flow chart of an embodiment of the present invention.

Next, an overview of operations of the printer 1 in the double-sided printing mode will be described with reference to FIG. 3. The control section 30 activates the process which is shown in FIG. 3 when the front edge of the sheet P which is drawn out from the sheet supply cassette by the reversing roller 12*a* and the relay roller 13*a* reaches the sheet sensor 43 during execution of a print job which is set in the double-sided printing mode. The transport distance of the sheet P uses the detection position of the sheet sensor 43 as a reference. That is, the distance between the front edge of the sheet P which is transported in the forward direction and the detection position of the sheet sensor 43 is the transport distance. Here, the carriage 21 is at the home position H in a period where a print job is not being executed and the carriage 21 is moved to the retracted position when printing is complete with regard to the printing region of the final surface of the sheet in a period where a print job is being executed. Accordingly, at the point in time when step S1 starts, the carriage 21 is always outside of the passing range of the sheet.

Figure 6A:
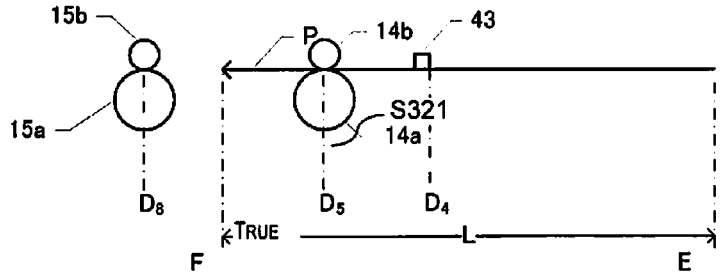
FIGS. 6A to 6E are state transition diagrams of an embodiment of the present invention.

Firstly, the control section 30 transports the sheet P in the forward direction to a target position where the front edge of the sheet P passes a contact point of the input roller 14*a* and the driven roller 14*b* (S1). When the front edge of the sheet P passes the contact point of the input roller 14*a* and the driven roller 14*b*, the sheet P is held by the input roller 14*a* and the driven roller 14*b* as shown in FIG. 6A. Below, holding of the sheet by the input roller 14*a* and the driven roller 14*b* will be referred to as holding of the sheet by the input roller 14*a*. In addition, holding of the sheet by the output roller 15*a* and the driven roller 15*b* will be referred to as holding of the sheet by the output roller 15*a*.

Next, the control section 30 acquires the next target positions to which the sheet P will be transported (S2). Here, the next target positions are each of the target positions in two transporting processes of the sheet which are not yet executed. The target position to which the sheet P will be transported is set according to the position of the target region on the sheet P. Then, the target region is defined by the contents of the print job. Here, the target position is shown by the transport distance from the detection position of the sheet sensor 43.

Next, the control section 30 determines whether or not the sheet P is held by both of the input roller 14*a* and the output roller 15*a* at the current position based on the transport distance of the sheet P to the current position and the length of the sheet P in the transport direction (S3). The combination of the input and output rollers which hold the sheet P has the relationship in the following table with the transport distance of the sheet P in the forward direction with the sheet sensor 43 as a reference. Here, the length of the sheet P which is set in the print job in the transport direction is L. In addition, a transport segment from $D_N$ to $D_M$ is expressed as $D_N/D_M$ and the distance from $D_N$ to $D_M$ is expressed as $|D_N/D_M|$.

TABLE 1

| Transport Distance d of Sheet P | Roller for Holding Sheet P |
|---|---|
| $\lvert D_4/D_5\rvert \le d < \lvert D_4/D_8\rvert$ | Input Roller |
| $\lvert D_4/D_8\rvert \le d \le \lvert D_4/D_5\rvert + L$ | Input Roller and Output Roller |
| $\lvert D_4/D_5\rvert + L < d \le \lvert D_4/D_8\rvert + L$ | Output Roller |

That is, in a case where the transport distance to the current position of the sheet P satisfies $|D_4/D_8| \le d \le |D_5/D_4| + L$, the control section 30 determines that the sheet P is held by both of the input roller 14*a* and the output roller 15*a*.

In a case where the sheet P is not held by both of the input roller 14*a* and the output roller 15*a*, the control section 30 prints on the current target region in a retracted mode (S5). As will be described later, transporting of the sheet P in the retracted mode is started after the print head 22 is stopped at the retracted position. In addition, movement of the print head 22 and transporting of the sheet P do not overlap. That is, movement of the print head 22 is started after the sheet P reaches the target position and stops, with the print head 22 stopping at any one of the retracted positions. As a result, the print head 22 is prevented from coming into contact with the sheet P.

Here, when the sheet P is transported to the current target position when printing on the current target region in a case where the sheet P is not being held by both of the input roller 14*a* and the output roller 15*a*, it is possible to change the combination of the input and output rollers which hold the sheet P as in the following (1) according to the distance from the current position to the target position.

Figure 6B:
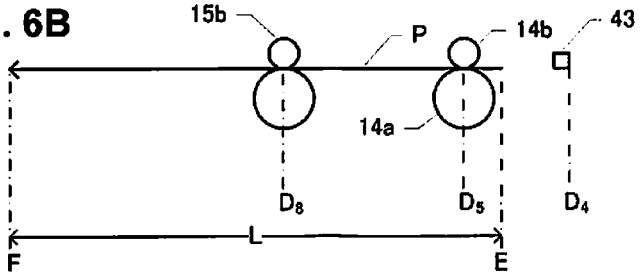

(1) The sheet P is transported in the forward direction from the position where the sheet P is held by the input roller 14*a* as shown in FIG. 6A and there is a change to a state of the sheet P being held by both of the input roller 14*a* and the output roller 15*a* as shown in FIG. 6B.

When the combination of the input and output rollers which hold the sheet P changes during transporting of the sheet P as in (1), a front edge F of the sheet P hits the vicinity of the contact point of the output roller 15*a* and the driven roller 15*b* immediately before being drawn into the output roller 15*a* and the driven roller 15*b*. In the period from the sheet P hitting the vicinity of the contact point of the output roller 15*a* and the driven roller 15*b* to being drawn into the output roller 15*a* and the driven roller 15*b*, there is a concern that the sheet P which is pushed out in the forward direction by the input roller 14*a* will be bent and come into contact with the print head 22.

Since transporting of the sheet P is only performed in the retracted mode in the state where the print head 22 is retracted to the retracted position, the sheet P and the print head 22 do not come into contact even if the sheet P hits the input and output rollers and bends for an instant since the print head 22 is retracted at the retracted position which is outside of the range where the sheet P passes. In addition, since the print head 22 is only moved in the state where the sheet P is stopped in the retracted mode, the sheet P and the print head 22 do not come into contact even if the sheet P hits the input and output rollers and bends for an instant.

In a case where the sheet P is held by both of the input roller 14*a* and the output roller 15*a*, the control section 30 determines whether or not the sheet P is in a state of being held by both of the input roller 14*a* and the output roller 15*a* even in a state where the sheet P is being transported to the current target position based on the current target position and the length L of the sheet P in the transport direction (S4). In a state where the sheet P is transported to the current target position, the control section 30 prints on the current target region in the retracted mode (S5) in a case where the sheet P is not in a state of being held by both of the input roller 14*a* and the output roller 15*a*.

Here, when the sheet P is transported to the current target position when printing on the current target region in a case where the sheet P is being held by both of the input roller 14*a* and the output roller 15*a*, it is possible to change the combination of the input and output rollers which hold the sheet P as in the following (2) according to the distance from the current position to the target position.

Figure 6C:
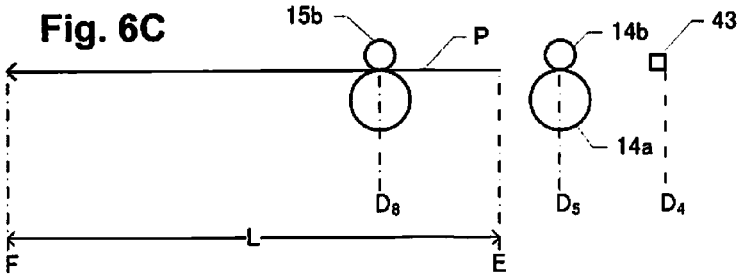
Figure 6D:
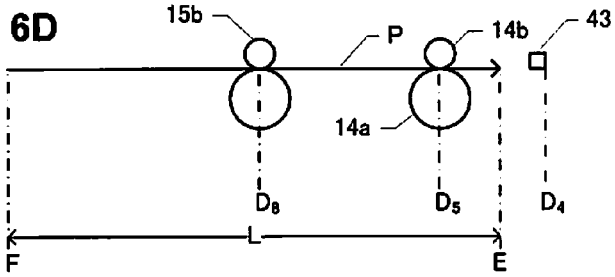

(2) The sheet P is transported in the forward direction from the position where the sheet P is held by both of the input roller 14*a* and the output roller 15*a* as shown in FIG. 6B and there is a change to a state of the sheet P being held by the output roller 15*a* as shown in FIG. 6C.

When the combination of the input and output rollers which hold the sheet P changes during transporting of the sheet P as in (2), it is easy for a rear edge E of the sheet P to come into contact with the print head 22 due to being warped upward. Since transporting of the sheet P is only performed in the retracted mode in the state where the print head 22 is retracted to the retracted position even when, for example, the sheet is held by both of the input roller 14*a* and the output roller 15*a* prior to transporting, the sheet P and the print head 22 do not come into contact even if the rear edge of the sheet P is warped upward since the print head 22 is retracted at the retracted position which is outside of the range where the sheet P passes.

In a case where the sheet P is held by both of the input roller 14*a* and the output roller 15*a* at the current position and the sheet P is in a state of being held by both of the input roller 14*a* and the output roller 15*a* even in a state where the sheet P is transported to the current target position, the control section 30 prints on the current target region in an overlap mode (S6). As will be described later, the movement target for the print head 22 is set in the overlap mode as either one of the retracted positions or within the range where the sheet P passes according to the target position in the next transporting. Then, movement of the print head 22 and transporting of the sheet P overlap. That is, movement of the print head 22 is started before the sheet P reaches the current target position and stops, and the next transporting of the sheet P, where the print head 22 reaches the movement target and stops, is started. Accordingly, it is possible to shorten the time for printing.

When printing on the current target region is complete, the control section 30 determines whether or not printing on the final target region of the second surface of the sheet P is currently complete based on the print job (S7). That is, it is determined whether printing on both sides of the sheet P is complete based on the print job.

In a case where printing on the final target region of the second surface of the sheet P is not currently complete, the control section 30 determines whether or not printing on the final target region of the first surface of the sheet P is currently complete based on the print job (S8). In a case where printing on the final target region of the first surface of the sheet P is not currently complete, the control section 30 returns to the process in step S2. Accordingly, the control section 30 repeats the processes from step S2 to step S8 until printing on all of the target regions of the first surface of the sheet P is complete.

Figure 6E:
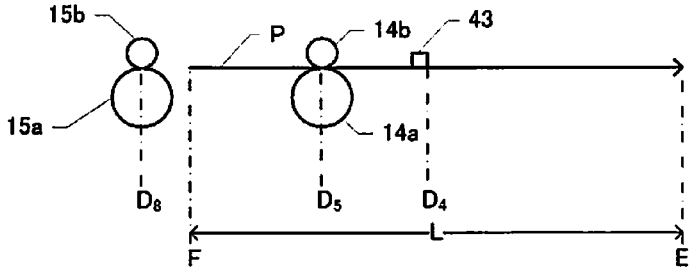

When printing on the final target region of the first surface of the sheet P is complete, there are cases where the sheet P is held by one of the input roller 14*a* and the output roller 15*a* and cases where the sheet P is held by both of the input roller 14*a* and the output roller 15*a*, but when the sheet P is transported in the backward direction in order to carry out reversing, the sheet P is always released from the output roller 15*a* as shown in FIG. 6E to be in a state of being held by the input roller 14*a*. Accordingly, there is a concern that the sheet P will come into contact with the print head 22 in a case where the print head 22 is positioned in the range where the sheet P passes when the sheet P is transported in the backward direction in order to carry out printing on the second surface of the sheet P.

In addition, in a case where the sheet P is held by the output roller 15*a* as shown in FIG. 6C when printing on the final target region of the first surface of the sheet P is complete, there are times when the rear edge E of the sheet P hits the vicinity of the contact point of the input roller 14*a* and the driven roller 14*b* immediately before being drawn in by the input roller 14*a* and the driven roller 14*b*. In the period from the sheet hitting the vicinity of the contact point of the input roller 14*a* and the driven roller 14*b* to being drawn into the input roller 14*a* and the driven roller 14*b*, there is a concern that the sheet P which is pushed out in the backward direction by the output roller 15*a* will be bent and come into contact with the print head 22.

Therefore, in a case where printing on the final target region of the first surface of the sheet P is currently complete, the control section 30 moves the print head 22 from the current position to the retracted position by driving the carriage motor 32 (S9). At this time, the control section 30 may move the print head 22 to the first retracted position or may move the print head 22 to the second retracted position. For example, the print head 22 may be moved to a retracted position which is closer to the current position, or may be moved to a retracted position which is positioned directly in front of the print head 22 in the moving direction.

After printing on the final target region of the first surface of the sheet P is currently complete and the print head 22 is moved to the retracted position, the control section 30 reverses the sheet P in order to carry out printing on the second surface of the sheet P (S10). In detail, the control section 30 sets the target position, such that the position of the rear edge of the sheet P after transporting during printing on the first surface is further away than $D_9$ which is the contact point between the relay roller 13*a* and the driven roller 13*c*, and rotates the input roller 14*a* and the output roller 15*a* clockwise in FIG. 1 by reversing the sheet feeding motor 34 from the rotation direction during printing. Due to this, the sheet P is transported in the backward direction and the rear edge of the sheet P is drawn into the relay roller 13*a* and the driven roller 13*c* by being guided by the flexible guide 13*d* during printing on the first surface. In addition, the control section 30 rotates the relay roller 13*a* and the reversing roller 12*a* counterclockwise in FIG. 1 by reversing the sheet feeding motor 34 from the rotation direction during printing at the same time as rotating the sheet supply motor 36 in the same direction as during printing. As a result, the sheet P is reversed by passing in the order of $D_9$, $D_1$, $D_2$, and $D_3$.

After reversing the sheet P, the control section 30 repeats the determination of whether or not the front edge of the sheet P has reached $D_4$ which is the detection position of the sheet sensor 43 based on an output value from the sheet sensor 43 (S11). Here, the front edge of the sheet P at this point is the side of the sheet which was the rear edge during printing on the first surface of the sheet P.

When the front edge of the sheet P reaches $D_4$ which is the detection position of the sheet sensor 43, the control section 30 returns to the process in step S1 and repeats the processes from step S2 to step S8 until printing on the final target region of the second surface of the sheet P is complete.

When printing on the final target region of the second surface of the sheet P is complete, there are cases where the sheet P is held by one of the input roller 14*a* and the output roller 15*a* and cases where the sheet P is held by both of the input roller 14*a* and the output roller 15*a*, but when the sheet P is transported in the forward direction in order to carry out discharging of the sheet P, the sheet P is always released from the input roller 14*a* as shown in FIG. 6C to be in a state of being held by the output roller 15*a*. Accordingly, there is a concern that the sheet P will come into contact with the print head 22 in a case where the print head 22 is positioned in the range where the sheet P passes when the sheet P is transported in the forward direction in order to discharge the sheet P.

In addition, in a case where the sheet P is held by the input roller 14*a* as shown in FIG. 6C when printing on the final target region of the second surface of the sheet P is complete, the front edge F of the sheet P hits the vicinity of the contact point of the output roller 15*a* and the driven roller 15*b* immediately before being drawn into the output roller 15*a* and the driven roller 15*b*. In the period from the sheet hitting the vicinity of the contact point of the output roller 15*a* and the driven roller 15*b* to being drawn into the output roller 15*a* and the driven roller 15*b*, there is a concern that the sheet P which is pushed out in the forward direction by the input roller 14*a* will be bent and come into contact with the print head 22.

Therefore, when printing on the final target region of the second surface of the sheet P is complete, the control section 30 moves the print head 22 to the retracted position in the same manner as in step S8 (S12).

After the printing on the final target region of the second surface of the sheet P is complete and the print head 22 is moved to the retracted position, the control section 30 discharges the sheet P to a stacker which is not shown in the diagram (S13). In detail, the control section 30 sets the target position of the rear edge of the sheet P further away than $D_8$ which is the contact point between the output roller 15*a* and the driven roller 15*b* during printing on the second surface, and rotates the input roller 14*a* and the output roller 15*a* counterclockwise in FIG. 1 by rotating the sheet feeding motor 34 in the same direction as during printing. Due to this, the sheet P is transported in the forward direction and discharged to the stacker.

3. Printing in Overlap Mode

Figure 4:
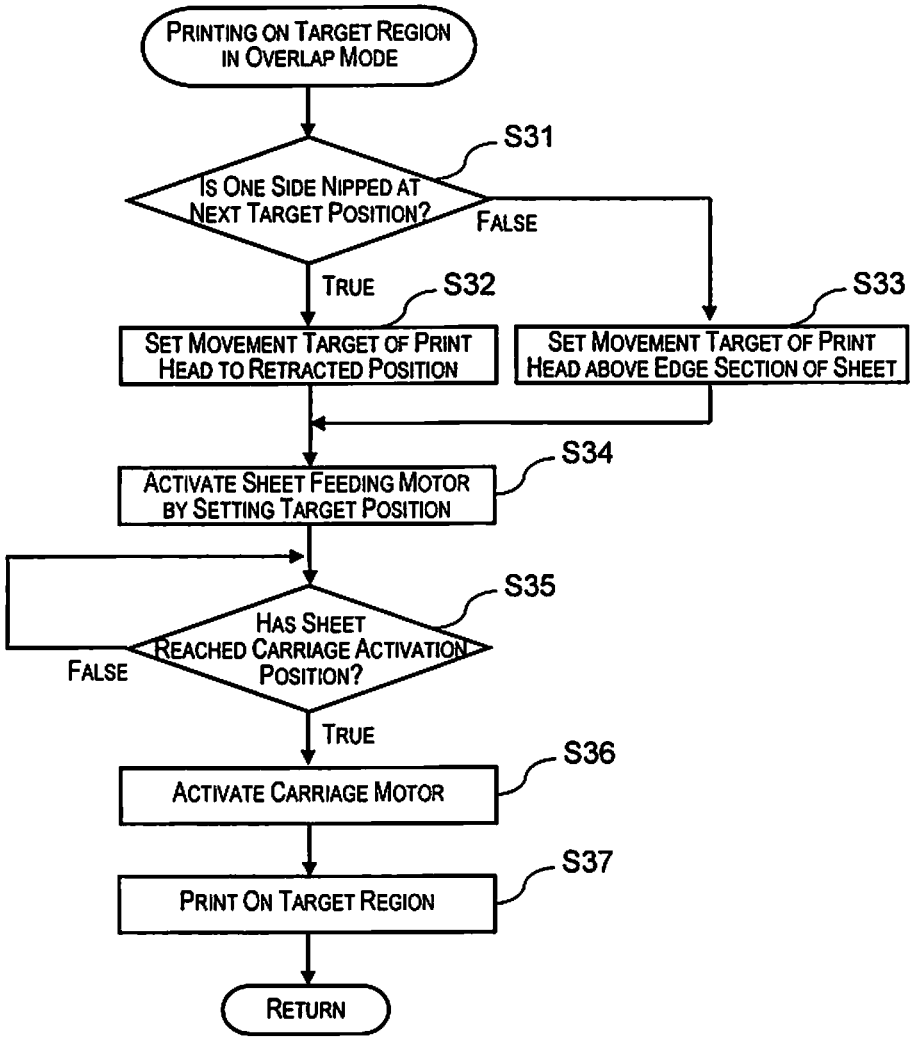
FIG. 4 is a flow chart of an embodiment of the present invention.

Next, a process where printing is carried out on the target region in the overlap mode will be described in detail with reference to FIG. 4.

Firstly, the control section 30 determines whether or not the sheet P would be in a state of being held by either one of the input roller 14*a* or the output roller 15*a* if the sheet P were transported to the next target position which is acquired in step S2 (S31).

In a case where the sheet P is in a state of being held by either one of the input roller 14*a* or the output roller 15*a* when the sheet P is transported to the next target position, the control section 30 sets the movement target for the print head 22 to the retracted position (S32). As a result, when transporting of the sheet P to the next target position is started in the retracted mode which will be described later, the print head 22 is in a state of being stopped at the retracted position.

In a case where the sheet P is not in a state of being held by either one of the input roller 14*a* or the output roller 15*a* even when the sheet P is transported to the next target position, the control section 30 sets the movement target for the print head 22 to a region on an edge section of the sheet P which is on the side which faces the current target region when viewed from the current position (S33). That is, in a case where the sheet P is held by both of the input roller 14*a* and the output roller 15*a* at the current position and the sheet P is held by both of the input roller 14*a* and the output roller 15*a* at the current target position and at the next target position, the movement target for the print head 22 is set within the range where the sheet P passes. Since it is possible to shorten the movement distance of the print head 22 by setting the movement target for the print head 22 to within the range where the sheet P passes, it is possible to shorten the time for printing.

When the movement target for the print head 22 is set in step S32 or step S33, the control section 30 activates the sheet feeding motor 34 and starts transporting of the sheet P (S34) by setting the current target position.

Next, the control section 30 repeats the determination of whether or not the sheet P has reached a carriage activation position until the sheet P reaches the carriage activation position, which is in front of the current target position by a predetermined distance, based on output from the rotary encoder 44 (S35). The carriage activation position is in a range where the sheet P reaches the target position in the time from when the print head 22 starts moving from above an edge section of the sheet P due to activating of the carriage motor 32 at this position until the print head 22 reaches the edge which is closest to the target region when viewed from the current position of the print head 22.

When the sheet P reaches a carriage movement position, the control section 30 activates the carriage motor 32 (S36). That is, the control section 30 starts the process of controlling the carriage motor 32 in the driving circuit 31 based on the movement target which is set in step S32 or in step S33 and the measurement value of the rotary encoder 46. When the carriage motor 32 is activated, the print head 22 which is mounted in the carriage 21 starts moving from the region above an edge section of the sheet P or the retracted position. It is possible to shorten the time for printing by starting movement of the print head 22 at a timing when the sheet P reaches the carriage activation position which is in front of the current target position.

When the carriage motor 32 is activated, the control section 30 prints onto the current target region by discharging ink droplets from the print head 22 according to the current position of the print head 22. The current position of the print head 22 is derived based on output from a home position sensor 42 and a linear encoder 41. When the print head 22 is moved from one edge of the current target region to the other edge of the current target region, printing on the current target region is complete.

When printing on the current target region is complete in the overlap mode, the flow proceeds to the process in step S7 which is shown in FIG. 3 without waiting for the print head 22 to reach the movement target. Accordingly, in a case where printing is executed in the overlap mode even for the next target region, transporting of the sheet P in step S34 is started for the next target region during movement of the print head 22. In this overlap mode, it is possible to shorten the time for printing by starting transporting of the sheet P toward the next target position before the print head 22 reaches the current movement target. Here, since printing in the overlap mode is executed only when the determination result in step S4 is true, the sheet P is held by both of the input roller 14*a* and the output roller 15*a* when printing on the current target region is complete in the overlap mode. Accordingly, the sheet P does not come into contact with the carriage 21 even during movement of the carriage 21 when starting transporting of the sheet P toward the next target position.

On the other hand, when printing on the current target region is complete in the retracted mode, as will be described later, transporting of the sheet P is not started during movement of the carriage 21 in the retracted mode and movement of the carriage 21 is not started during transporting of the sheet P since there are cases where the sheet P is not held by both of the input roller 14*a* and the output roller 15*a*.

4. Printing in Retracted Mode

Figure 5:
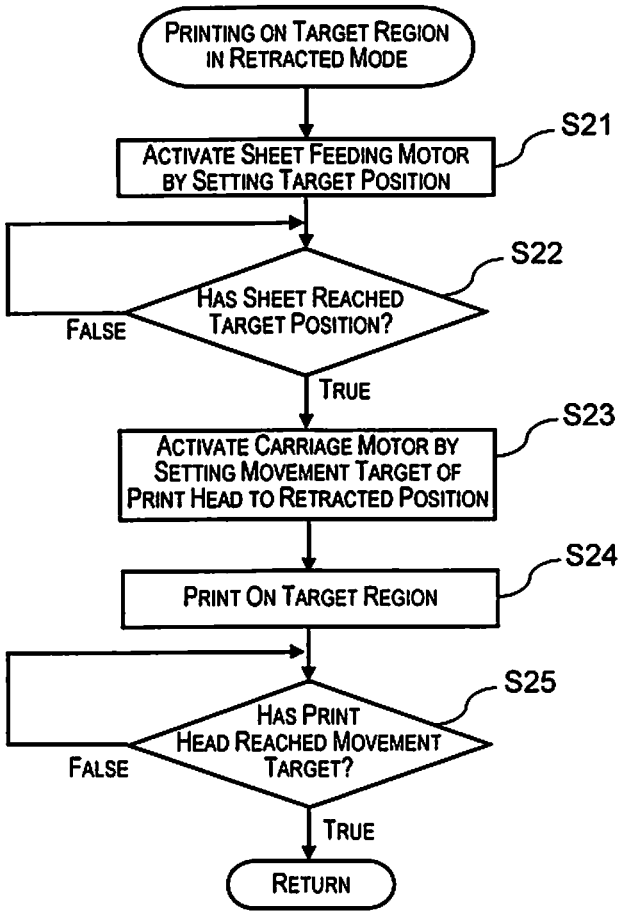
FIG. 5 is a flow chart of an embodiment of the present invention.

Next, a process where printing is carried out on the target region in the retracted mode will be described in detail with reference to FIG. 5.

Firstly, the control section 30 activates the sheet feeding motor 34 by setting the current target position which is acquired in step S2 in the driving circuit 33 (S21). As a result, transporting of the sheet P is started. The driving circuit 33 sets a target speed according to the distance between the current position and the target position when the target position is set. The driving circuit 33 derives the current position and the current speed based on output from the rotary encoder 44 and carries out feedback control of the sheet feeding motor 34 based on the distance between the current position and the target position and the difference between the target speed and the current speed.

As will be described later, the movement target for the print head 22 is always set to a retracted position which is outside of the range where the sheet P passes in the retracted mode. In addition, as already described, in a case where the printing is executed in the overlap mode, there are times when the movement target for the print head 22 is set to be above an edge section region of the sheet P which is not the retracted position. However, setting the movement target for the print head 22 to be above an edge section region of the sheet P which is not the retracted position is only for cases where the sheet P is held by both of the input roller 14*a* and the output roller 15*a* at the current position and the target position, when the sheet is transported after moving the print head 22 with the movement target set as above the edge section of the sheet P, is also a position where the sheet P is held by both of the input roller 14*a* and the output roller 15*a*. Then, printing in the retracted mode is not executed in a case where the target position, when the sheet is transported after moving the print head 22 with the movement target set as above the edge section of the sheet P, is also a position where the sheet P is held by both of the input roller 14*a* and the output roller 15*a*. Accordingly, the print head 22 always stops at the retracted position when transporting of the sheet P is started in step S21. That is, the print head 22 always stops at the retracted position which is outside of the range where the sheet P passes when the sheet P is transported in the retracted mode where the sheet P is in a state of being held by either one of the input roller 14*a* and the output roller 15*a* when the sheet P is transported from the current position to the next target position. Accordingly, the print head 22 and the sheet P do not come into contact when the sheet P is transported in the retracted mode.

Next, the control section 30 determines whether or not the sheet P has reached the target position until the sheet P reaches the target position based on output from the rotary encoder 44 (S22). When the sheet P reaches the target position, the current printing region is positioned at a segment from $D_6$ to $D_7$ which is directly below the print head 22.

When the sheet P reaches the target position, the control section 30 activates the carriage motor 32 by setting the movement target for the print head 22 to the retracted position (S25). That is, the control section 30 starts a process of controlling the carriage motor 32 in the driving circuit 31 based on the movement target which is set in step S32 or in step S33 and the measurement value of the rotary encoder 46. When the carriage motor 32 is activated, the print head 22 which is mounted in the carriage 21 starts moving from one retracted position toward the other retracted position.

Here, the retracted position is set according to the width of the sheet P in the main scanning direction (the width of a passing region of the sheet) which is set in the print job. That is, in a case where the width of the sheet P in the main scanning direction which is set in the print job is narrow, the distance from the one retracted position to the other retracted position is shorter. Accordingly, the back and forth movement distance of the carriage 21 is shorter in a case where the width of the sheet P in the main scanning direction which is set in the print job is narrow, and the back and forth movement distance of the carriage 21 is longer in a case where the width of the sheet P in the main scanning direction which is set in the print job is wide. In this manner, it is possible to shorten the distance which the carriage 21 moves in order to retract to the retracted position by setting the retracted position according to the width of the sheet P in the main scanning direction.

When the carriage motor 32 is activated, the control section 30 prints onto the current target region by discharging ink droplets from the print head 22 according to the current position of the print head 22 (S24). The current position of the print head 22 is derived based on output from the home position sensor 42 and the linear encoder 41. When the print head 22 is moved from one edge of the current target region to the other edge of the current target region, printing on the current target region is complete.

Here, the print head 22 moves to the retracted position which is the movement target which is currently set without stopping even upon reaching the edge of the current target region. As a result, it is possible to shorten the time for printing compared with a case where the print head 22 is moved to the retracted position by reactivating the carriage motor 32 according to the current position of the sheet P after stopping the print head 22 at the edge of the current target region or stopping the print head 22 at the edge section region of the sheet.

When printing on the current target region is complete, the control section 30 repeats the determination of whether or not the print head 22 has reached the current movement target based on output from the linear encoder 41 until the print head 22 reaches the current movement target which is the retracted position (S25). When the print head 22 reaches the current movement target and stops, the control section 30 completes the process in step S5 as shown in FIG. 3 and proceeds to the determination in step S7.

According to the embodiment described above, it is determined in step S3 and step S4 whether or not the combination of the input and output rollers which hold the sheet P would change due to transporting of the sheet P to the target position, and in a case where the combination would change, the sheet P is transported from the current position to the target position in a retracted state where the print head is retracted to the retracted position after the print head 22 is moved to the retracted position which is outside of the range where the sheet P passes. As a result, it is possible to prevent the sheet P and the print head 22 from coming into contact. In addition, printing is carried out on the target region in the overlap mode in a case where the sheet P is held by both of the input roller 14*a* and the output roller 15*a* and the combination of the input and output rollers which hold the sheet P does not change due to transporting of the sheet P to the target position. As a result, it is possible to shorten the time for printing.

5. Other Embodiments

Here, the technical range of the present invention is not limited to the embodiments described above, and it is clear that various types of modifications are possible within a scope which does not depart from the gist of the present invention.

For example, instead of acquiring the target position in advance in the current sheet transporting and determining whether or not the combination of the input and output rollers which hold the sheet in the current sheet transporting would change based on the current position and the target position, the current target position may be temporarily set by regarding the current transport distance as a fixed distance which is decided in advance (for example, the length of the print head in the sheet transport direction) and whether or not the combination of the input and output rollers which hold the sheet in the current sheet transporting would change may be determined based on the current position and the target position which is temporarily set.

In addition, for example, instead of determining whether the current movement target for the print head is set within the range where the sheets pass or set to the retracted position by acquiring the next target position prior to transporting, the target positions in the current and next sheet transporting may be temporarily set by regarding the distance for each transporting of the sheet as a fixed distance which is decided in advance (for example, the length of the print head in the sheet transport direction) and whether the current movement target for the print head is set within the range where the sheets pass or set to the retracted position may be determined according to the current and the next target positions which are temporarily set.

In addition, in the embodiment described above, the print head 22 is moved to the retracted position before activating the sheet feeding motor 34 in order to reverse the sheet after the printing on the final target region of one surface of the sheet was complete and before activating the sheet feeding motor 34 in order to discharge the sheet. Instead, for example, in a case where it is determined whether or not the sheet is held by both of the input roller 14*a* and the output roller 15*a* at the point of time when printing on the final target region of one surface of the sheet is complete and the sheet is held by both of the input roller 14*a* and the output roller 15*a*, the print head 22 may be moved to the retracted position before the sheet is released from either one of the input roller 14*a* and the output roller 15*a* in the period where the sheet is transported in the backward direction so as to be reversed and in the period where the sheet is transported in the forward direction so as to be discharged without moving the print head 22 prior to the start of transporting of the sheet.

In addition, in the embodiment described above, the position of the sheet is specified with when the front edge of the sheet P reaches the sheet sensor 43 as a reference, but the position of the sheet may be specified with when the rear edge of the sheet P reaches the sheet sensor 43 after the sheet sensor 43 detects the rear edge of the sheet P as a reference. There are cases where errors occur in the position of the sheet in transporting from the front edge of the sheet P being detected until the rear edge of the sheet P is detected, but it is possible to carry out a reset even if an error occurs due to transporting as long as the position is specified with when the rear edge is detected as a reference. In addition, since when the sheet rear edge is detected is used as a reference, it is possible to reliably specify the position of the rear edge of the sheet even in a case where setting of the length of the sheet according to a driver is mistaken.

In addition, in the overlap mode, instead of setting the movement target for the print head 22 to be above the edge section region of the sheet without regard to the target region, the movement distance of the print head may be further shortened by executing so-called logical seeking where the current movement target is set to the edge of the current moving region or the edge of the next moving region according to the edge of the current moving region and the edge of the next moving region.

In addition, the edge of the sheet may be detected using a non-contact sensor other than an optical sensor, the edge of the sheet may be detected using a contact sensor, or displacement of the sheet may be measured using only the rotary encoder of the sheet supply motor.

In addition, the reversing roller 12*a*, the relay roller 13*a*, the input roller 14*a*, and the output roller 15*a* may be driven by a common actuator. In this case, a mechanism which stops transferring of the driving force from the actuator to the reversing roller 12*a* and the relay roller 13*a* during driving of the input roller 14*a* and the output roller 15*a* is necessary. In addition, a stepping motor may be used or a servo motor may be used as the actuator which drives the reversing roller 12*a*, the relay roller 13*a*, the input roller 14*a*, and the output roller 15*a*.

In addition, it is possible to adopt a configuration in the print head according to another printing system such as a thermal transfer system or a dot impact system as well as the ink jet system.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printer comprising:

a pair of input rollers configured and arranged to pinch a print medium;

a pair of output rollers configured and arranged to pinch the print medium;

a print head configured and arranged to print onto a target region on the print medium while moving between the input rollers and the output rollers in a direction which intersects with a transport direction of the print medium; and a control section configured to transport the print medium by rotating the input rollers and the output rollers after printing on the target region and before printing on a next target region, the control section being configured to determine, before carrying out transporting, whether or not a combination of the input rollers and the output rollers which pinch the print medium would change in a case where the print medium were transported from a current position to a next target position, and, in a case where there would be a change, the control section being configured to transport the print medium from the current position to the target position in a retracted state where the print head is moved to an outside of a range where the print medium passes.

2. The printer according to claim 1, wherein the control section is configured to transport the print medium from the current position to the target position in the retracted state after the print head is moved to the outside of the range where the print medium passes in a case where a state where the print medium is pinched by either pair of the input rollers or the output rollers is changed to a state where the printing medium is pinched by both pairs of the input rollers and the output rollers when the print medium is transported from the current position to the next target position.

3. The printer according to claim 1, wherein the control section is configured to transport the print medium from the current position to the target position in the retracted state after the print head is moved to the outside of the range where the print medium passes in a case where a state where the print medium is pinched by both pairs of the input rollers and the output rollers is changed to a state where the printing medium is pinched by either pair of the input rollers or the output rollers when the print medium is transported from the current position to the next target position.

4. The printer according to claim 1, wherein the control section is also configured to transport the print medium during movement of the print head in a case where the print medium is pinched by both pairs of the input rollers and the output rollers and not to transport the print medium during movement of the print head in a case where the print medium is pinched by either pair of the input rollers or the output rollers.

5. The printer according to claim 1, wherein the control section is configured to set a movement target of the print head to the outside of the range where the print medium passes before carrying out printing.

6. The printer according to claim 1, wherein the control section is configured to set a retracted position of the print head based on a width of the print medium which is set in a print job.

7. A printer comprising:

a pair of input rollers configured and arranged to pinch a print medium;

a pair of output rollers configured and arranged to pinch the print medium;

a print head configured and arranged to print onto a target region on the print medium while moving between the input rollers and the output rollers in a direction which intersects with a transport direction of the print medium; and a control section configured to transport the print medium by rotating the input rollers and the output rollers after printing on the target region and before printing on the next target region, wherein, in a case where the print medium is transported to a next target position by being pinched by either pair of the input rollers or the output rollers after printing on a final surface of the print medium, the control section is configured to transport the print medium from a current position to the next target position in a retracted state after the print head is moved to an outside of a range where a print medium passes.

8. The printer according to claim 7, wherein the control section is configured to move the print head to the outside of the range where the print medium passes before the print medium is transported in a direction from the input rollers toward the output rollers after final printing on the print medium.

9. The printer according to claim 7, wherein the control section is configured to move the print head to the outside of the range where the print medium passes before the print medium is transported in a direction from the output rollers toward the input rollers in order to carry out printing on a second surface of the print medium after printing on a first surface of the print medium.

* * * * *